US010060283B2

(12) United States Patent
Tomigashi et al.

(10) Patent No.: US 10,060,283 B2
(45) Date of Patent: Aug. 28, 2018

(54) RANKINE-CYCLE POWER-GENERATING APPARATUS

(71) Applicant: Panasonic Corporation, Osaka (JP)

(72) Inventors: Yoshio Tomigashi, Osaka (JP); Takumi Hikichi, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 15/280,808

(22) Filed: Sep. 29, 2016

(65) Prior Publication Data

US 2017/0107846 A1 Apr. 20, 2017

(30) Foreign Application Priority Data

Oct. 16, 2015 (JP) ..... 2015-204697

(51) Int. Cl.

| | |
|---|---|
| ***F01D 17/00*** | (2006.01) |
| ***F01D 15/10*** | (2006.01) |
| ***F01K 13/02*** | (2006.01) |
| *F03B 17/00* | (2006.01) |

(52) U.S. Cl.

CPC ..... *F01D 17/00* (2013.01); *F01D 15/10* (2013.01); *F01K 13/02* (2013.01); *F03B 17/005* (2013.01); *Y10S 415/916* (2013.01)

(58) Field of Classification Search

CPC ..... F01D 17/00; F01D 15/10

See application file for complete search history.

(56) References Cited

U.S. PATENT DOCUMENTS

| | | | | |
|---|---|---|---|---|
| 4,029,255 | A * | 6/1977 | Heiser | F01D 17/24 415/15 |
| 4,205,380 | A * | 5/1980 | Braytenbah | F01D 17/00 290/40 R |
| 2002/0066270 | A1* | 6/2002 | Rouse | F01K 23/10 60/670 |
| 2009/0217665 | A1* | 9/2009 | Holzhauer | F01D 17/00 60/645 |

(Continued)

FOREIGN PATENT DOCUMENTS

| | | |
|---|---|---|
| JP | 2005-312289 | 11/2005 |
| JP | 2008-180462 A | 8/2008 |

(Continued)

OTHER PUBLICATIONS

The Extended European Search Report dated Mar. 30, 2017 for the related European Patent Application No. 16194093.7.

*Primary Examiner* — Sean Gugger

(74) *Attorney, Agent, or Firm* — McDermott Will & Emery LLP

(57) ABSTRACT

Specific operation is executable in a Rankine-cycle power-generating apparatus. In the Rankine-cycle power-generating apparatus, a) in the specific operation, the control device adjusts the degree of opening of the opening/closing device so that the direct-current electric power absorbed by the electric power absorber approaches first electric power, or b) in the specific operation, the degree of opening of the opening/closing device is increased to the predetermined intermediate degree of opening so that the direct-current electric power absorbed by the electric power absorber falls within a predetermined range.

15 Claims, 7 Drawing Sheets

(56) References Cited

U.S. PATENT DOCUMENTS

| | | | | |
|---|---|---|---|---|
| 2012/0247134 | A1* | 10/2012 | Gurin | F24D 11/02 62/129 |
| 2014/0102098 | A1* | 4/2014 | Bowan | F01K 7/32 60/645 |
| 2014/0208751 | A1* | 7/2014 | Bowan | F01K 7/165 60/647 |
| 2015/0322821 | A1* | 11/2015 | Adachi | F01K 23/02 60/646 |

FOREIGN PATENT DOCUMENTS

| | | |
|---|---|---|
| JP | 2015-083829 | 4/2015 |
| WO | 2012/176826 | 12/2012 |

* cited by examiner

RANKINE-CYCLE POWER-GENERATING APPARATUS

BACKGROUND

1. Technical Field

The present disclosure relates to a Rankine-cycle power-generating apparatus.

2. Description of the Related Art

It is conventionally common to connect a distributed power source device to a commercial system. Japanese Patent No. 4889956 (hereinafter referred to as Patent Literature 1), Japanese Patent No. 5637310 (hereinafter referred to as Patent Literature 2), and Japanese Unexamined Patent Application Publication No. 2015-083829 (hereinafter referred to as Patent Literature 3) describe techniques concerning a distributed power source device, a commercial system, control, and the like. In the invention described in Patent Literature 1, a power-generating apparatus utilizing thermal energy is used as a distributed power source device.

Specifically, in the power-generating apparatus of Patent Literature 1, a working fluid evaporates in a steam generator. An expander generates mechanical power from the working fluid. A generator generates alternating-current power from the mechanical power. A rectifier converts the alternating-current electric power to direct-current electric power. An inverter generates alternating-current electric power of a predetermined frequency from the direct-current electric power. The rectifier and the inverter are connected to each other via a direct-current electric power line. A heater is connected to the direct-current electric power line in order to prevent no-load running of the power-generator during power outage or the like.

SUMMARY

The power-generating apparatus of Patent Literature 1 has a room for improvement from the perspective of a reduction in size and from the perspective of an improvement of reliability. In view of such circumstances, one non-limiting and exemplary embodiment provides a technique that achieves both a reduction in size and an improvement of reliability.

In one general aspect, the techniques disclosed here feature a Rankine-cycle power-generating apparatus including: a Rankine-cycle device including: an expander that converts expansion energy of a working fluid into mechanical energy, a bypass flow channel that bypasses the expander, an opening/closing device that opens/closes the bypass flow channel and whose degree of opening is adjustable to any of a fully opened state, a fully closed state, and an intermediate degree of opening between the fully opened state and the fully closed state; and a power generator that is linked to the expander and a control device including: a converter that converts alternating-current electric power generated by the power generator into direct-current electric power, an inverter that is connected to the converter via a direct-current electric power line and is capable of converting the direct-current electric power into alternating-current electric power and feeding the alternating-current electric power to a commercial system, and an electric power absorber that absorbs part of or all of the direct-current electric power, specific operation being executable in the Rankine-cycle power-generating apparatus, a) in the specific operation, the control device adjusting the degree of opening of the opening/closing device so that the direct-current electric power absorbed by the electric power absorber approaches first electric power, or b) in the specific operation, the degree of opening of the opening/closing device being increased to the predetermined intermediate degree of opening so that the direct-current electric power absorbed by the electric power absorber falls within a predetermined range.

The Rankine-cycle power-generating apparatus is excellent from the perspective of both a reduction in size and an improvement in reliability.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
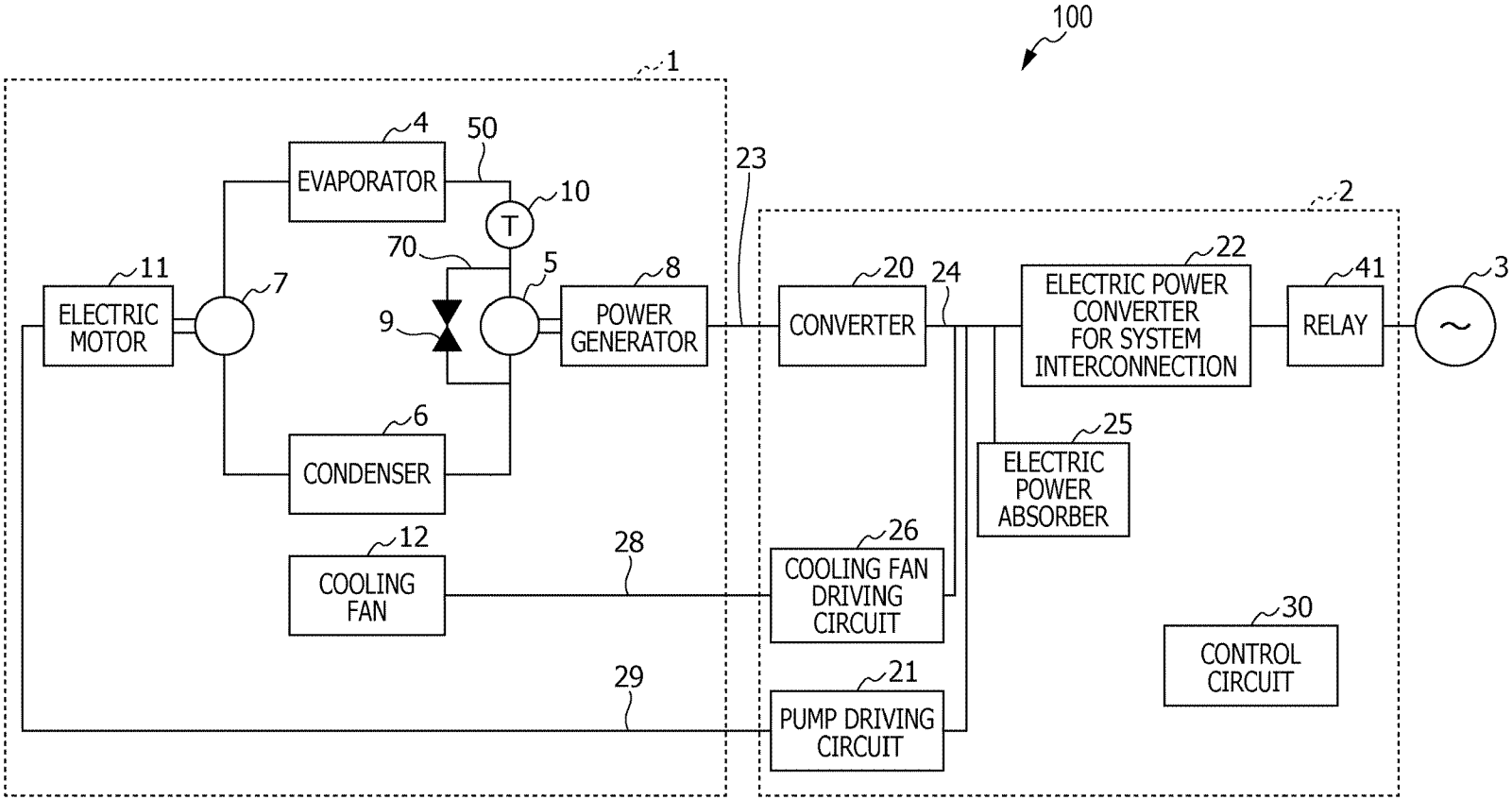
FIG. 1 is a block diagram of a Rankine-cycle power-generating apparatus according to Embodiment 1.

The inventors of the present invention considered an improvement of the power-generating apparatus of Patent Literature 1 from the perspective of achievement of both a reduction in size and an improvement in reliability. One option for reducing the size of a power-generating apparatus is to reduce the size of a heater. One option for reducing the size of a heater is to restrict electric power consumption in the heater during occurrence of an abnormality (e.g., power failure of a commercial system). One option for restricting electric power consumption in the heater during occurrence of an abnormality is to restrict electric power generated by a power-generator during occurrence of an abnormality. One option for restricting electric power generated by a power-generator during occurrence of an abnormality is to lower the quantity of heat generated in a heat source immediately after occurrence of an abnormality. However, if the quantity of heat generated in a heat source is lowered immediately after occurrence of an abnormality, there is a risk of failure to secure electric power that should be secured during occurrence of an abnormality. Specifically, there are cases where part of generated electric power is used for a pump of a Rankine-cycle device, or the like, and if electric power used for driving the pump increases in such cases, it sometimes becomes difficult to continue operation of the Rankine-cycle device due to shortage of electric power or it sometimes becomes difficult to safely stop the Rankine-cycle device.

As a result of diligent studies, the inventors of the present invention found that it is effective to properly adjust the degree of opening of an opening/closing device to achieve both a reduction in size and an improvement in reliability (especially continuation of operation and safe stoppage of a Rankine-cycle device during occurrence of an abnormality). The present disclosure is based on such finding.

That is, a first aspect of the present disclosure provides a Rankine-cycle power-generating apparatus including:

a Rankine-cycle device including:

an expander that converts expansion energy of a working fluid into mechanical energy, a bypass flow channel that bypasses the expander, an opening/closing device that opens/closes the bypass flow channel and whose degree of opening is adjustable to any of a fully opened state, a fully closed state, and an intermediate degree of opening between the fully opened state and the fully closed state, and a power generator that is linked to the expander, and a control device including:

a converter that converts alternating-current electric power generated by the power generator into direct-current electric power, an inverter that is connected to the converter via a direct-current electric power line and is capable of converting the direct-current electric power into alternating-current electric power and feeding the alternating-current electric power to a commercial system, and an electric power absorber that absorbs part of or all of the direct-current electric power, specific operation being executable in the Rankine-cycle power-generating apparatus, a) in the specific operation, the control device adjusting the degree of opening of the opening/closing device so that the direct-current electric power absorbed by the electric power absorber approaches first electric power, or b) in the specific operation, the degree of opening of the opening/closing device being increased to the predetermined intermediate degree of opening so that the direct-current electric power absorbed by the electric power absorber falls within a predetermined range.

In a) of the first aspect, the degree of opening of the opening/closing device is adjusted so that the direct-current electric power absorbed by the electric power absorber approaches the first electric power. By setting the first electric power to one that is not excessively large, it is possible to prevent the direct-current electric power absorbed by the electric power absorber from becoming excessively large. It is therefore possible to reduce the size of the electric power absorber. In a case where the first electric power is made large to some extent, an increase in electric power consumption in the Rankine-cycle device can be smoothly compensated. It is therefore possible to continue operation of the Rankine-cycle device and safely stop the Rankine-cycle device. That is, by setting the first electric power to a proper value according to specification, it is possible to achieve both a reduction in size of the Rankine-cycle power-generating apparatus and an improvement in reliability of the Rankine-cycle power-generating apparatus. For example, reliability of the Rankine-cycle power-generating apparatus during a system abnormality such as power failure is secured by performing the specific operation during the system abnormality. For the above reasons, the specific operation in a) of the first aspect is suitable for both a reduction in size of the Rankine-cycle power-generating apparatus and an improvement in reliability of the Rankine-cycle power-generating apparatus. Note that the first electric power is, for example, not less than 1% and not more than 60% of rated electric power of the power-generating apparatus.

In b) of the first aspect, the degree of opening of the opening/closing device is increased to the predetermined intermediate degree of opening so that the direct-current electric power absorbed by the electric power absorber falls within the predetermined range. This makes it possible to prevent the electric power absorbed by the electric power absorber from becoming excessively large. It is therefore possible to reduce the size of the electric power absorber. Furthermore, since it is possible to prevent the electric power absorbed by the electric power absorber from becoming excessively small, it is easy to smoothly compensate an increase in electric power consumption in the Rankine-cycle device. For the above reasons, b) of the first aspect is suitable for both a reduction in size of the Rankine-cycle power-generating apparatus and an improvement in reliability of the Rankine-cycle power-generating apparatus. Note that the predetermined range is not less than 1% and not more than 60% of the rated electric power of the power-generating apparatus.

In addition to the first aspect, a second aspect of the present disclosure provides a Rankine-cycle power-generating apparatus in which A) in the specific operation, the control device adjusts the degree of opening of the opening/closing device by feedback control using the degree of opening of the opening/closing device as a manipulated variable so that the direct-current electric power absorbed by the electric power absorber approaches the first electric power; or b) in the specific operation, the degree of opening of the opening/closing device is increased to the predetermined intermediate degree of opening so that the direct-current electric power absorbed by the electric power absorber falls within the predetermined range.

According to the feedback control in A) of the second aspect, a) of the first aspect can be easily realized.

In addition to the first aspect or the second aspect, a third aspect of the present disclosure provides a Rankine-cycle power-generating apparatus in which α) in the specific operation, the control device adjusts the degree of opening of the opening/closing device so that the direct-current electric power absorbed by the electric power absorber approaches the first electric power, and in the specific operation, when electric power consumption in the Rankine-cycle device increases, the direct-current electric power absorbed by the electric power absorber temporarily decreases and electric power fed from the control device to the Rankine-cycle device increases, and then the direct-current electric power approaches the first electric power again; or β) in the specific operation, the degree of opening of the opening/closing device is increased to the predetermined intermediate degree of opening so that the direct-current electric power absorbed by the electric power absorber falls within the predetermined range, and in the specific operation, when the electric power consumption in the Rankine-cycle device increases, the direct-current electric power absorbed by the electric power absorber decreases and electric power fed from the control device to the Rankine-cycle device increases.

α) and β) of the third aspect are typical behaviors of electric power when electric power consumption in the Rankine-cycle device increases in the specific operation.

In addition to any one of the first through third aspects, a fourth aspect of the present disclosure provides a Rankine-cycle power-generating apparatus in which the Rankine-cycle device further includes a pump that delivers the working fluid by pressure; and in the specific operation, part of the direct-current electric power is used as electric power for driving the pump.

According to the specific operation of the fourth aspect, electric power necessary for driving the pump can be secured even during power failure of the commercial system. Furthermore, electric power generated by the power generator can be effectively utilized.

In addition to the first aspect, a fifth aspect of the present disclosure provides a Rankine-cycle power-generating apparatus in which a) in the specific operation, the control device adjusts the degree of opening of the opening/closing device so that the direct-current electric power absorbed by the electric power absorber approaches the first electric power, and A) in the specific operation, the control device adjusts the degree of opening of the opening/closing device by feedback control using the degree of opening of the opening/closing device as a manipulated variable so that the direct-current electric power absorbed by the electric power absorber approaches the first electric power; or α) in the specific operation, the control device adjusts the degree of opening of the opening/closing device so that the direct-current electric power absorbed by the electric power absorber approaches the first electric power, and in the specific operation, when electric power consumption in the Rankine-cycle device increases, the direct-current electric power absorbed by the electric power absorber temporarily decreases and electric power fed from the control device to the Rankine-cycle device increases, and then the direct-current electric power approaches the first electric power again.

As for effects of the fifth aspect, see the effects of the first aspect, the second aspect, and the third aspect.

In addition to the fifth aspect, a sixth aspect of the present disclosure provides a Rankine-cycle power-generating apparatus in which the Rankine-cycle device further includes a pump that delivers the working fluid by pressure;

in the specific operation, part of the direct-current electric power is used as electric power for driving the pump; and in the specific operation, when the degree of opening of the opening/closing device decreases to a first degree of opening, a rotational speed of the pump starts to decrease.

In addition to the fifth aspect, a seventh aspect of the present disclosure provides a Rankine-cycle power-generating apparatus in which the Rankine-cycle device further includes:

a pump that delivers the working fluid by pressure, an evaporator that heats the working fluid, and a sensor that is used to specify a temperature of the working fluid that is present in a flow passage starting from an exit of the evaporator and ending at an entry of the expander, in the specific operation, part of the direct-current electric power is used as electric power for driving the pump; and in the specific operation, when the temperature specified by the sensor decreases to a first temperature, a rotational speed of the pump starts to decrease.

Decreasing the rotational speed of the pump after the temperature of the working fluid decreases to some extent as defined in the seventh aspect is proper from the perspective of securing safety of the Rankine-cycle device. In a case where the opening/closing device is adjusted so that the direct-current electric power absorbed by the electric power absorber approaches the first electric power, the degree of opening of the opening/closing device basically decreases upon decrease of the temperature of the working fluid. Therefore, decreasing the rotational speed of the pump after the degree of opening of the opening/closing device decreases to some extent as defined in the sixth aspect is proper from the same perspective. Furthermore, since electric power consumption of the pump can be reduced by decreasing the rotational speed of the pump as in the specific operation of the sixth aspect and the seventh aspect, a situation where an operation continuation period of the Rankine-cycle device cannot be secured due to shortage of generated electric power is less likely to occur. Furthermore, in a case where the rotational speed of the pump decreases, it becomes easy to stop the pump.

In addition to the sixth aspect or the seventh aspect, an eighth aspect of the present disclosure provides a Rankine-cycle power-generating apparatus in which in the specific operation, when the rotational speed of the pump decreases, a rotational speed of the expander decreases.

According to the Rankine-cycle power-generating apparatus of the eighth aspect, electric power generated by the power generator can be decreased in accordance with a decrease in electric power consumption of the pump. Therefore, a situation where an operation continuation period of the Rankine-cycle device cannot be secured due to shortage of generated electric power is less likely to occur. Furthermore, in a case where the rotational speed of the expander decreases, it becomes easy to stop the expander.

In addition to any one of the sixth through eighth aspects, a ninth aspect of the present disclosure provides a Rankine-cycle power-generating apparatus in which a rotational speed of the expander and the rotational speed of the pump are set to zero in a case where any of the following e) through g) is satisfied:

e) the direct-current electric power absorbed by the electric power absorber is equal to or smaller than second electric power, f) a direct-current voltage of the direct-current electric power line is lower than a first voltage, and g) the rotational speed of the pump or the expander is equal to or lower than a first rotational speed; and the second electric power is smaller than the first electric power.

According to the Rankine-cycle power-generating apparatus of the ninth aspect, driving of the expander and the pump can be stopped after the temperature of the working fluid decreases sufficiently. Therefore, the Rankine-cycle power-generating apparatus of the ninth aspect is suitable from the perspective of safety of the device.

In addition to the ninth aspect, a tenth aspect of the present disclosure provides a Rankine-cycle power-generating apparatus in which the degree of opening of the opening/closing device is increased in a case where any of the following E) and G) is satisfied:

E) the direct-current electric power absorbed by the electric power absorber is equal to or smaller than third electric power, and G) the rotational speed of the pump or the expander is equal to or smaller than a second rotational speed;

the third electric power is smaller than the first electric power and is larger than the second electric power; and the second rotational speed is larger than the first rotational speed.

In a case where any of the conditions e) through g) of the ninth aspect is satisfied, there are cases where the temperature of the working fluid is low and the working fluid contains liquid. Accordingly, the working fluid at the entry of the expander sometimes contains liquid after driving of the expander is stopped according to the ninth aspect. According to the tenth aspect, the degree of opening of the opening/closing device can be increased before driving of the expander is stopped. This reduces a difference in pressure of the working fluid between the exit and entry of the expander after stoppage of driving. Accordingly, the working fluid containing liquid is less likely to flow into the expander after stoppage of driving.

In addition to any one of the fifth through tenth aspects, an eleventh aspect of the present disclosure provides a Rankine-cycle power-generating apparatus in which the control device further includes a control circuit that controls the inverter, the electric power absorber, and the opening/closing device; and in the specific operation, the control circuit computes an electric current command that is an electric current that should flow into the electric power absorber and adjusts the degree of opening of the opening/closing device so that the direct-current electric power absorbed by the electric power absorber approaches the first electric power by using the electric current command.

According to the Rankine-cycle power-generating apparatus of the eleventh aspect, the specific operation in which the direct-current electric power absorbed by the electric power absorber approaches the first electric power can be performed without a sensor for measuring the direct-current electric power.

In addition to any one of the fifth through eleventh aspects, a twelfth aspect of the present disclosure provides a Rankine-cycle power-generating apparatus in which the Rankine-cycle device further includes a condenser that cools the working fluid; and in the specific operation, the control device adjusts the degree of opening of the opening/closing device and adjusts an amount of heat discharge of the condenser.

A change of the degree of opening of the opening/closing device can affect the magnitude of thermal energy stored in the Rankine-cycle device and the temperature of the working fluid. In the twelfth aspect, not only the degree of opening of the opening/closing device, but also the amount of heat discharge of the condenser are adjusted. This makes it easy to keep the thermal energy stored in the Rankine-cycle device and the temperature of the working fluid within a proper range. It is therefore possible to prevent an excessive increase in temperature at the exit of the evaporator.

In a specific example of the twelfth aspect, in a case where the direct-current electric power absorbed by the electric power absorber is larger than the first electric power, the degree of opening of the opening/closing device is increased, and heat discharge capability of the condenser is increased. This makes it less likely that the temperature at the exit of the evaporator excessively increases even in a case where the degree of opening of the opening/closing device increases and thermal energy extracted by the expander decreases.

In addition to the twelfth aspect, a thirteenth aspect of the present disclosure provides a Rankine-cycle power-generating apparatus in which the Rankine-cycle device further includes a cooling fan that cools the condenser; and in the specific operation, the control device adjusts the amount of heat discharge of the condenser by adjusting a rotational speed of the cooling fan.

According to the thirteenth aspect, the effects of the twelfth aspect can be obtained by air cooling.

In a specific example of the thirteenth aspect, in a case where the direct-current electric power absorbed by the electric power absorber is larger than the first electric power, the rotational speed of the cooling fan is increased so as to increase the heat discharge capability of the condenser.

In addition to the thirteenth aspect, a fourteenth aspect of the present disclosure provides a Rankine-cycle power-generating apparatus in which in the specific operation, the cooling fan is driven by using part of the direct-current electric power.

According to the Rankine-cycle power-generating apparatus of the fourteenth aspect, electric power necessary for driving of the cooling fan can be secured even during power failure of the commercial system. Furthermore, electric power generated by the power generator can be effectively utilized.

In addition to any one of the first through fourteenth aspects, a fifteenth aspect of the present disclosure provides a Rankine-cycle power-generating apparatus in which the specific operation is performed while the Rankine-cycle device is being disengaged from the commercial system.

The specific operation of the first aspect etc. can be suitably performed while the Rankine-cycle device is being disengaged from the commercial system.

The first aspect of the present disclosure can be also expressed by a Rankine-cycle power-generating apparatus including:

a Rankine-cycle device; and a control device, the Rankine-cycle device including an expander that converts expansion energy of a working fluid into mechanical energy, a bypass flow channel that bypasses the expander, an opening/closing device that opens/closes the bypass flow channel and whose degree of opening is adjustable to any of a fully opened state, a fully closed state, and an intermediate degree of opening between the fully opened state and the fully closed state, and a power generator that is linked to the expander and converts the mechanical energy into first alternating-current electric power;

the Rankine-cycle device having an operation mode including specific operation;

the control device including:

a converter that converts the first alternating-current electric power generated by the power generator into direct-current electric power, an inverter that is connected to the converter via a direct-current electric power line and is capable of converting the direct-current electric power into second alternating-current electric power and feeding the second alternating-current electric power to a commercial system, an electric power absorber that absorbs part of or all of the direct-current electric power, and a control circuit, in the specific operation, that a) causes the opening/closing device to adjust the degree of opening of the opening/closing device so that the direct-current electric power absorbed by the electric power absorber approaches first electric power or b) causes the opening/closing device to adjust the degree of opening of the opening/closing device to the predetermined intermediate degree of opening so that the direct-current electric power absorbed by the electric power absorber falls within a predetermined range.

Embodiments of the present disclosure are described below with reference to the drawings. The present disclosure is not limited to the embodiments below.

Embodiment 1

Configuration of Power-Generating Apparatus

As illustrated in FIG. 1, a power-generating apparatus (Rankine-cycle power-generating apparatus) 100 according to Embodiment 1 includes a Rankine-cycle device 1 and a control device (Rankine-cycle control device) 2. The Rankine-cycle device 1 is connected to the control device 2. The control device 2 can be connected to an external electric power system (commercial system) 3. The electric power system 3 can feed electric power to the Rankine-cycle device 1. Electric power is sometimes fed from the Rankine-cycle device 1 to the electric power system 3. The electric power system 3 is, for example, a commercial alternating-current power source.

The Rankine-cycle device 1 includes a fluid circuit 50, a power generator 8, an electric motor 11, and a cooling fan 12. The fluid circuit 50 is a circuit through which a working fluid flows. The fluid circuit 50 constitutes a Rankine cycle.

The fluid circuit 50 includes a pump 7, an evaporator 4, an expander 5, and a condenser 6. These members are connected in a circular pattern in this order via a plurality of pipes. A sensor 10 for specifying the temperature of the working fluid is provided at an entry of the expander 5. The fluid circuit 50 further includes a bypass flow channel 70 that bypasses the expander 5. An upstream end of the bypass flow channel 70 is connected between an exit of the evaporator 4 and the entry of the expander 5 in the fluid circuit 50. A downstream end of the bypass flow channel 70 is connected between an exit of the expander 5 and an entry of the condenser 6 in the fluid circuit 50. The bypass flow channel 70 has a bypass valve (opening/closing device) 9.

The power generator 8 is linked to the expander 5. The electric motor 11 is linked to the pump 7. The power generator 8 is driven by the expander 5. The electric motor 11 drives the pump 7.

The pump 7 is an electrically-driven pump. The pump 7 allows a liquid working fluid to circulate. A specific example of the pump 7 is a general positive-displacement or rotodynamic pump. Examples of the positive-displacement pump include a piston pomp, a gear pump, a vane pump, and a rotary pump. Examples of the rotodynamic pump include a centrifugal pump, a mixed flow pump, and an axial pump. The pump 7 is not linked to the expander 5. That is, a rotary shaft of the pump 7 and a rotary shaft of the expander 5 are separate from each other. This allows the pump 7 to work independently of the expander 5.

The evaporator 4 is a heat exchanger that absorbs thermal energy of combustion gas generated in a boiler (not illustrated). The evaporator 4 is, for example, a finned tube heat exchanger and is disposed inside the boiler. The combustion gas generated in the boiler and the working fluid in the Rankine-cycle device 1 exchange heat in the evaporator 4. This heats and evaporates the working fluid. Note that although the boiler is used as a heat source and the combustion gas is used as a heat medium in this example, another heat source and another heat medium may be used. For example, a heat source utilizing waste heat energy discharged from a facility such as a factory or an incinerator may be used.

The expander 5 expands the working fluid and converts expansion energy (thermal energy) of the working fluid into rotative power. The power generator 8 is connected to the rotary shaft of the expander 5. The expander 5 drives the power generator 8. The expander 5 is, for example, a positive-displacement or rotodynamic expander. Examples of the positive-displacement expander include a scroll expander, a rotary expander, a screw expander, and a reciprocating expander. The rotodynamic expander is a so-called expansion turbine.

The condenser 6 of the present embodiment cools the working fluid through heat exchange between the working fluid ejected from the expander 5 and cooling air delivered from the cooling fan 12. A finned tube heat exchanger can be suitably used as the condenser 6. In the present embodiment, cooling air is used as the heat medium that exchanges heat with the working fluid, but cooling water may be used as the heat medium. In a case where a liquid heat medium such as water is passed through a heat medium circuit, a plate heat exchanger or a double-pipe heat exchanger can be suitably used as the condenser 6.

The bypass valve (opening/closing device) 9 is a valve whose degree of opening can be changed. Specifically, the degree of opening of the bypass valve 9 can be changed to any of a fully opened state, a fully-closed state, and an intermediate degree of opening between the fully opened state and the fully-closed state. By changing the degree of opening of the bypass valve 9, the amount of flow of the working fluid that bypasses the expander 5 can be adjusted.

Note that the term "degree of opening" as used herein is a percentage of a cross-sectional area of a passage through which the working fluid passes assume that a cross-sectional area of a passage through which the working fluid passes when the bypass valve 9 (opening/closing device) is fully opened is 100%.

The sensor 10 is a sensor used to specify (detect or estimate) a temperature Ts of the working fluid that is present in a flow passage starting from the exit of the evaporator 4 and ending at the entry of the expander 5. In this example, the sensor 10 is a temperature sensor used to specify (detect) the temperature Ts. In another example, the sensor 10 is a pressure sensor used to specify (estimate) the temperature Ts. Since there is a correlation between a pressure and a temperature, the temperature Ts can be estimated from a detection value (value of pressure) obtained by the pressure sensor. In this example, the sensor 10 directly detects the temperature Ts by making contact with the working fluid. Note, however, that the sensor 10 may be one that indirectly detect the temperature Ts by detecting the temperature of a wall that constitutes the flow passage. The wall is typically constituted by a pipe.

The position of the sensor 10 is not limited in particular, provided that the sensor 10 can obtain a detection value that can be used to specify the temperature Ts. The sensor 10 can be provided at any position in the flow passage starting from the exit of the evaporator 4 and ending at the entry of the expander 5 (or any position of the wall that constitutes the flow passage). However, the sensor 10 may be provided on an upstream side (evaporator 4 side) of the bypass valve 9 in the bypass flow channel 70. That is, the sensor 10 can be provided at a position where pressure and temperature are likely to rise to the same extent as the exit of the evaporator 4 and the entry of the expander 5 in the fluid circuit 50.

An outline of an operation of the Rankine-cycle device 1 is as follows. The pump 7 feeds and circulates the working fluid by pressure. The evaporator 4 heats the working fluid by using heat from the heat source (not illustrated) such as a boiler. This brings the working fluid into a state of overheated steam (gas). The working fluid that has been brought into the state of overheated steam flows into the expander 5. The working fluid that has flowed into the expander 5 adiabatically-expands in the expander 5. This generates driving force in the expander 5, thereby causing the expander 5 to operate. That is, the expander 5 converts expansion energy (thermal energy) into mechanical energy. As the expander 5 operates, the power generator 8 operates and generates electric power. That is, the power generator 8 converts the mechanical energy into electric energy. In other words, the thermal energy is converted into electric energy by the expander 5 and the power generator 8. The condenser 6 cools the working fluid ejected from the expander 5 by using cooling water, cooling air, or the like. This condenses the working fluid into a state of liquid. The liquid working fluid is sucked in by the pump 7.

The control device 2 controls the Rankine-cycle device 1. The control device 2 includes a converter 20, a pump driving circuit 21, a cooling fan driving circuit 26, an electric power converter for system interconnection (inverter) 22, an electric power absorber 25, a relay 41, and a control circuit 30. The converter 20 is connected to the power generator 8 via an alternating-current wire (first alternating-current wire) 23. The pump driving circuit 21 is connected to the electric motor 11 via an alternating-current wire (second alternating-current wire) 29. The cooling fan driving circuit 26 is connected to the cooling fan 12 via an alternating-current wire (third alternating-current wire) 28. The electric power converter for system interconnection 22 can be connected to the electric power system 3 via the relay 41. The converter 20, the electric power converter for system interconnection 22, and the electric power absorber 25 are connected to one another via a direct-current electric power line 24. The relay 41 is connected to the electric power converter for system interconnection 22 via an alternating-current wire. The control device 2 acquires a signal for specifying the temperature Ts.

To the electric power converter for system interconnection 22, alternating-current electric power is fed from the electric power system 3 via the relay 41. The electric power converter for system interconnection 22 converts the alternating-current electric power fed from the electric power system 3 into direct-current electric power. The direct-current electric power thus obtained is fed to the pump driving circuit 21 and the cooling fan driving circuit 26. The direct-current electric power is also fed to the converter 20. The converter 20 converts alternating-current electric power generated by the power generator 8 into direct-current electric power while the power generator 8 is generating electric power. The direct-current electric power thus obtained is fed to the pump driving circuit 21 and the cooling fan driving circuit 26. In a case where the direct-current electric power thus obtained is larger than direct-current electric power that should be fed to the pump driving circuit 21 and the cooling fan driving circuit 26, part (surplus electric power) of the obtained direct-current electric power is converted into alternating-current electric power by the electric power converter for system interconnection 22. This alternating-current electric power is fed (in a reverse power flow) to the electric power system 3 via the relay 41. The converter 20 can give the expander 5 braking torque or driving torque via the power generator 8.

The electric power converter for system interconnection (inverter) 22 is connected to the converter 20 via the direct-current electric power line 24 and is capable of converting direct-current electric power into alternating-current electric power and feeding the alternating-current electric power to the commercial system 3. The electric power converter for system interconnection 22 is capable of detecting whether the Rankine-cycle device 1 is in an isolated operation state. The isolated operation state is a state where the power-generating apparatus 100 is feeding effective electric power to a line load while the electric power system 3 is being isolated from a system power source due to an accident or the like. As for details of the isolated operation state (isolated operation), see Japanese Industrial Standards JIS B8121 (2009) for example. Note that an element other than the electric power converter for system interconnection 22 in the control device 2 may be in charge of detecting the isolated operation state.

A method for detecting the isolated operation is not limited in particular. An example of a method for detecting the isolated operation is a frequency shift method. An example of the frequency shift method is a method for detecting a change in frequency that appears during isolated operation by detecting (or estimating) a frequency of a system voltage (for example, every control cycle) and using, as a target output frequency of the electric power converter for system interconnection 22 in subsequent cycles (e.g., a next cycle), a frequency obtained by adding a minute amount of shift to a detection value thus obtained. As for a specific example of the method for detecting the isolated operation, see Patent Literature 2 for example.

In a case where the isolated operation state is detected by the electric power converter for system interconnection 22, the relay 41 disconnects (disengages) the power-generating apparatus 100 from the electric power system 3 in order to eliminate the isolated operation state.

Figure 2:
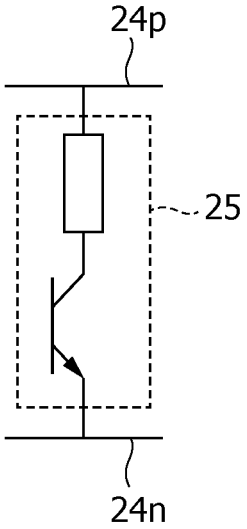
FIG. 2 is a block diagram of an electric power absorber.

The electric power absorber 25 absorbs direct-current electric power in the direct-current electric power line 24. In the present embodiment, the electric power absorber 25 absorbs electric power (surplus electric power) fed (in a reverse power flow) to the electric power system 3 upon detection of the isolated operation state. As illustrated in FIG. 2, the electric power absorber 25 according to the present embodiment has a discharging resistor that discharges electric power and a switching element that switches on/off feeding of an electric current to the electric power absorber 25. In the example of FIG. 2, the discharging resistor and the switching element are interposed between a positive-side wire 24*p* and a negative-side wire 24*n*. An example of the switching element is a semiconductor switch element such as an MOSFET (metal-oxide-semiconductor field-effect transistor). Note that the electric power absorber 25 is not limited to a specific one, provided that the electric power absorber 25 absorbs electric power. For example, a battery can be used instead of the discharging resistor.

The pump driving circuit 21 is capable of driving the pump 7 by using the electric motor 11 without the need for another power source circuit. The pump driving circuit 21 controls the pump 7 on the basis of a detection signal obtained by the sensor 10, or the like. This adjusts the amount of flow of the working fluid flowing through the evaporator 4.

The cooling fan driving circuit 26 is capable of driving the cooling fan 12 without the need for another power source circuit. The cooling fan driving circuit 26 controls the cooling fan 12, and thus the amount of heat exchange (heat discharging capability) of the condenser 6 is adjusted.

Control Sequence

Figure 3:
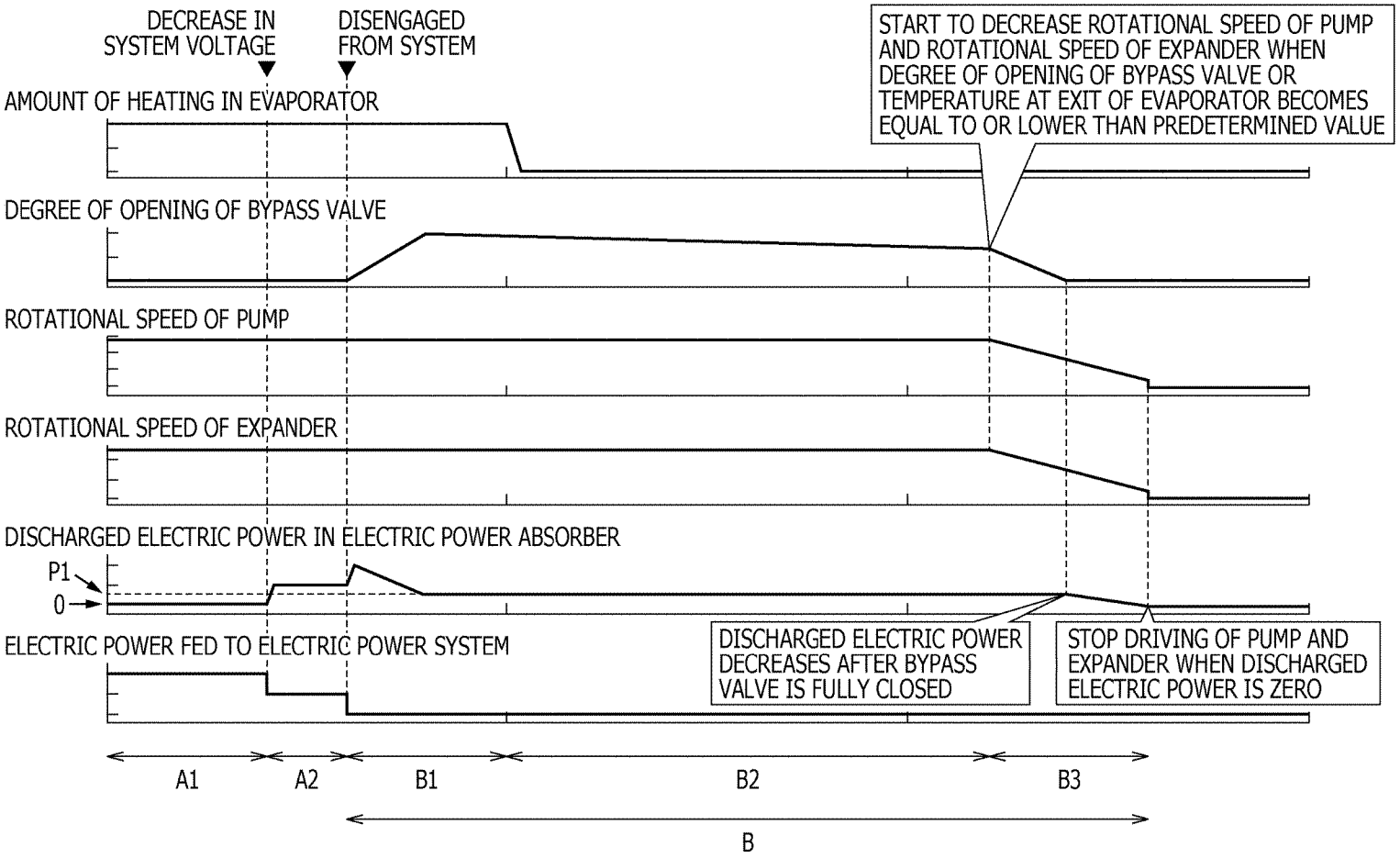
FIG. 3 is a timing chart for explaining operation of the Rankine-cycle power-generating apparatus according to Embodiment 1.

A control sequence of the Rankine-cycle power-generating apparatus 100 is described below with reference to FIG. 3. Note that the uppermost graph in FIG. 3 schematically illustrates a change in amount of heating of the working fluid in the evaporator 4 (the amount of heat per unit time given to the working fluid) over passage of time. The second graph from the top in FIG. 3 schematically illustrates a change in degree of opening of the bypass valve 9 over passage of time. The third graph from the top in FIG. 3 schematically illustrates a change in the rotational speed of the pump 7 over passage of time. The fourth graph from the top in FIG. 3 schematically illustrates a change in the rotational speed of the expander 5 over passage of time. The fifth graph from the top in FIG. 3 schematically illustrates a change in discharged electric power in the electric power absorber 25 over passage of time. The sixth graph from the top in FIG. 3 schematically illustrates a change in electric power fed from the power-generating apparatus 100 to the electric power system 3 over passage of time. The uppermost to sixth graphs in FIGS. 5 and 7 that will be described later also illustrate similar changes.

A period A1 is a period in which the electric power system 3 is normal and the power-generating apparatus 100 is in a normal operation state. During the period A1, electric power (surplus electric power) obtained by subtracting electric power used in the Rankine-cycle device 1 from electric power generated by the power generator 8 is entirely fed to the electric power system 3.

A period A2 is a period in which the voltage (system voltage) of the electric power system 3 decreases and electric power fed to the electric power system 3 is limited due to an electric current limitation set by the electric power converter for system interconnection 22. A point in time indicated by "DECREASE IN SYSTEM VOLTAGE" in FIG. 3 corresponds to the start of an isolated operation state. In the present embodiment, the normal operation is resumed in a case where the system voltage recovers within a predetermined limited period after detection of a decrease in the system voltage by the electric power converter for system interconnection 22 (in a case where the isolated operation state is eliminated). In a case where the system voltage does not recover within the limited period, transition to a period B that will be described later occurs. During the period A2, part of the surplus electric power is fed to the electric power system 3, and remaining surplus electric power is absorbed (discharged) by the electric power absorber 25. Although it may seem that the voltage (direct-current voltage) of the direct-current electric power line 24 rises when the electric power fed to the electric power system 3 is limited, the electric power discharged by the electric power absorber 25 is controlled so that the direct-current voltage becomes a target voltage in the present embodiment. Keeping the direct-current voltage at the target voltage is advantageous in terms of ensuring safety of the Rankine-cycle power-generating apparatus 100. The target voltage is typically a predetermined (unchanging) voltage. The target voltage is, for example, 300 V to 400 V. Note, however, that the target voltage may be a voltage that changes in accordance with an operation state of the power-generating apparatus 100, a state of the system (system voltage), or the like.

In a case where the system voltage does not recover within the predetermined limited period after detection of a decrease of the system voltage, the relay 41 disconnects (disengages) the Rankine-cycle device 1 from the electric power system 3. This forcibly eliminates the isolated operation state. The period B (periods B1, B2, and B3) is a period in which the Rankine-cycle device 1 is disengaged from the electric power system 3. Since the operation of the Rankine-cycle device 1 is stopped at the end of the period B, the period B can be referred to as a stoppage period. In the example illustrated in FIG. 3, in part of the periods B1, B2, and B3, the degree of opening of the bypass valve 9 is adjusted by the control device 2 so that electric power absorbed by the electric power absorber 25 becomes first electric power P1. In a case where the electric power absorbed by the electric power absorber 25 is larger than the first electric power P1, the degree of opening of the bypass valve 9 increases, and electric power generated by the power generator 8 decreases. As a result, the electric power absorbed by the electric power absorber 25 decreases and approaches the first electric power P1. According to such adjustment of the degree of opening of the bypass valve 9, a situation where the electric power absorbed by the electric power absorber 25 becomes far larger than the first electric power P1 does not occur. It is therefore possible to reduce the size of the electric power absorber 25.

In the present embodiment, operation in which the control device 2 controls the degree of opening of the bypass valve (opening/closing device) 9 so that direct-current electric power absorbed by the electric power absorber 25 approaches the first electric power P1 is referred to as specific operation. In the specific operation of the present embodiment, the control device 2 adjusts the degree of opening of the bypass valve 9 by feedback control using the degree of opening of the bypass valve 9 as a manipulated variable so that the direct-current electric power absorbed by the electric power absorber 25 approaches the first electric power P1. Furthermore, in the specific operation of the present embodiment, when electric power consumption in the Rankine-cycle device 1 increases, the direct-current electric power absorbed by the electric power absorber 25 temporarily decreases and electric power fed from the control device 2 to the Rankine-cycle device 1 increases, and then the direct-current electric power approaches the first electric power P1 again. As is clear from the above description, the specific operation of the present embodiment is performed while the Rankine-cycle device 1 is being disengaged from the electric power system (commercial system) 3. The specific operation of the present embodiment is operation for stopping the operation of the Rankine-cycle device 1. The specific operation of the present embodiment is performed in part of the periods B1, B2, and B3.

Typically, the first electric power P1 is predetermined (unchanging) electric power. The first electric power P1 is, for example, equal to or larger than 1% of rated electric power of the power-generating apparatus 100. Since electric power for driving the pump 7 (electric power consumption of the pump driving circuit 21) is generally equal to or lower than 10% of the rated electric power of the power-generating apparatus 100, the electric power absorber 25 in this example can absorb approximately 10% or larger of the electric power for driving the pump 7. Accordingly, even in a case where the driving electric power fluctuates to this extent, the fluctuation can be smoothly compensated. In a typical example, consumed electric power used to stop the Rankine-cycle device 1 is small, and therefore even in a case where electric power consumption of the Rankine-cycle device 1 fluctuates when the Rankine-cycle device 1 is stopped, the fluctuation can be smoothly compensated, as long as the first electric power P1 is equal to or larger than 1% of the rated electric power of the power-generating apparatus 100. That is, it is possible to safely stop the Rankine-cycle device 1. In this example, the first electric power P1 is equal to or lower than 30% of the rated electric power of the power-generating apparatus 100. Setting the first electric power P1 to a value that is not excessively high is advantageous from the perspective of a reduction in size of the electric power absorber 25. Note that the first electric power P1 may be electric power that changes in accordance with an operation state of the power-generating apparatus 100, and the like. In the example of FIG. 3, the discharged electric power is larger than the first electric power P1 during the period A2. However, this does not pose a problem because the period A2 is short.

However, in a case where the degree of opening of the bypass valve 9 is increased so that the generated electric power decreases, thermal energy converted into mechanical energy in the expander 5 decreases, and therefore there is a risk of an excessive rise of the temperature of the working fluid at the exit of the evaporator 4. In view of this, in the present embodiment, in the specific operation, the control device 2 adjusts not only the degree of opening of the bypass valve (opening/closing device) 9, but also the amount of discharge of heat of the condenser 6. Specifically, in a case where the direct-current electric power absorbed by the electric power absorber 25 is larger than the first electric power P1, the degree of opening of the bypass valve 9 is increased and the heat discharge capability of the condenser 6 is increased. More specifically, the control device 2 adjusts (increases) the amount of heat discharge of the condenser 6 by adjusting (increasing) the rotational speed of the cooling fan 12. This makes it possible to suppress a rise of the temperature of the working fluid at the exit of the evaporator 4. Note that the aforementioned control concerning the condenser 6 is also applicable in a case where the degree of opening of the bypass valve 9 is adjusted by feedforward as in Modification 1 that will be described later.

In the specific operation of the present embodiment, part of the direct-current electric power is used as electric power for driving the pump 7. In other words, part of the electric power generated by the power generator 8 is fed to the pump driving circuit 21 through the direct-current electric power line 24. Accordingly, even during power failure of the electric power system 3, it is possible to secure electric power necessary for driving the pump 7 and continue operation of the Rankine-cycle device 1. Furthermore, it is possible to effectively utilize the electric power generated by the power generator 8.

In the specific operation of the present embodiment, the cooling fan 26 is driven by using part of the direct-current electric power. In other words, part of the electric power generated by the power generator 8 is fed to the cooling fan driving circuit 26 through the direct-current electric power line 24. Accordingly, even during power failure of the electric power system 3, it is possible to secure electric power necessary for the cooling fan driving circuit 26 and continue operation of the Rankine-cycle device 1. Furthermore, it is possible to effectively utilize the electric power generated by the power generator 8.

See FIG. 3 again. The period B1 starts at the same time as disengagement of the Rankine-cycle device 1 from the electric power system 3. During the period B1, the whole surplus electric power is discharged by the electric power absorber 25. In an initial stage of the period B1, the control device 2 increases the degree of opening of the bypass valve 9 so that the discharged electric power decreases and approaches the first electric power P1. After the discharged electric power reaches the first electric power P1, the control device 2 adjusts the degree of opening of the bypass valve 9 so that the discharged electric power is kept at the first electric power P1.

The period B2 is a period from a time at which heating of the working fluid in the evaporator 4 is stopped to a time when the temperature of the working fluid at the exit of the evaporator 4 becomes equal to or lower than a first temperature (described later). During the period B2, the degree of opening of the bypass valve 9 gradually decreases because the control device 2 tries to keep the discharged electric power in the electric power absorber 25 at the first electric power P1 while the thermal energy of the working fluid is decreasing.

During the period B3, the rotational speed of the pump 7 decreases. In the present embodiment, the rotational speed of the pump 7 decreases to zero during the period B3. The period B3 starts when the temperature of the working fluid detected by the sensor 10 becomes equal to or lower than the first temperature. That is, in the present embodiment, in the specific operation, the rotational speed of the pump 7 starts to decrease when the temperature specified by the sensor 10 decreases to the first temperature. Decreasing the rotational speed of the pump 7 after the temperature of the working fluid decreases to some extent is proper from the perspective of securing safety of the Rankine-cycle device 1. When the rotational speed of the pump 7 is decreased, electric power consumption of the pump 7 can be reduced, and therefore a situation where an operation continuation period of the Rankine-cycle device 1 cannot be secured due to shortage of the generated electric power is less likely to occur. Furthermore, when the rotational speed of the pump 7 is decreased, it is easy to stop the pump 7. Typically, the first temperature is a predetermined (unchanging) temperature. The first temperature is, for example, 100° C. to 175° C. Note, however, that the first temperature may be a temperature that changes in accordance with an operation state of the Rankine-cycle power-generating apparatus 100, and the like.

In another example, the period B3 starts when the degree of opening of the bypass valve 9 decreases to a first degree of opening. That is, in the specific operation in this example, the rotational speed of the pump 7 starts to decrease when the degree of opening of the bypass valve (opening/closing device) 9 decreases to the first degree of opening. In a case where the bypass valve 9 is adjusted so that the direct-current electric power discharged in the electric power absorber 25 approaches the first electric power P1, the degree of opening of the bypass valve 9 basically decreases as the temperature of the working fluid decreases. Accordingly, decreasing the rotational speed of the pump 7 when the degree of opening of the bypass valve 9 decreases to some extent has similar meaning to decreasing the rotational speed of the pump 7 when the temperature of the working fluid decreases to some extent. The first degree of opening is, for example, 20% to 80%.

During the period B3, the rotational speed of the expander 5 is decreased in accordance with the rotational speed of the pump 7. That is, in the specific operation of the present embodiment, when the rotational speed of the pump 7 decreases, the rotational speed of the expander 5 decreases. Accordingly, a situation where the operation continuation period of the Rankine-cycle device 1 cannot be secured due to shortage of the generated electric power is less likely to occur. Furthermore, it becomes easy to stop the expander 5.

In the example illustrated in FIG. 3, the degree of opening of the bypass valve 9 is fully opened at a point during the period B3. After the degree of opening of the bypass valve 9 is fully opened, the discharged electric power in the electric power absorber 25 cannot be kept at the first electric power P1, and the discharged electric power decreases. Furthermore, from a point during the period B3, a direct-current voltage in the direct-current electric power line 24 cannot be kept at a target voltage, and the direct-current voltage decreases.

Driving of the pump 7 and the expander 5 is stopped and the period B3 ends when the discharged electric power in the electric power absorber 25 becomes equal to or lower than second electric power. That is, in the present embodiment, the rotational speed of the expander 5 and the rotational speed of the pump 7 are set to zero when a condition that the direct-current electric power absorbed by the electric power absorber 25 is equal to or lower than the second electric power is met. This makes it possible to stop driving of the expander 5 and the pump 7 when the temperature of the working fluid is sufficiently low. It is therefore easy to secure safety of the device. The second electric power is smaller than the first electric power P1. Typically, the second electric power is predetermined (unchanging) electric power. In the present embodiment, the second electric power is 0 W. Note, however, that the second electric power may be electric power that changes in accordance with an operation state of the Rankine-cycle power-generating apparatus 100, and the like.

Note that driving of the pump 7 and the expander 5 may be stopped when the direct-current voltage of the direct-current electric power line 24 becomes longer than a first voltage. That is, the rotational speed of the expander 5 and the rotational speed of the pump 7 may be set to zero when a condition that the direct-current voltage of the direct-current electric power line 24 is lower than the first voltage is met. This is because when the discharged electric power in the electric power absorber 25 becomes extremely small (becomes substantially 0 W), the direct-current voltage cannot be kept at the target voltage and the direct-current voltage decreases. The first voltage can be a voltage lower than the target voltage and is, for example, equal to or lower than 90% of the target voltage. A specific example of the first voltage is 50% of the target voltage. Typically, the first voltage is a predetermined (unchanging) voltage. Note, however, that the first voltage may be a voltage that changes in accordance with an operation state of the Rankine-cycle power-generating apparatus 100, and the like.

Alternatively, driving of the pump 7 and the expander 5 may be stopped when the rotational speed of the pump 7 or the expander 5 becomes smaller than a first rotational speed. That is, the rotational speed of the expander 5 and the rotational speed of the pump 7 may be set to zero when a condition that the rotational speed of the pump 7 or the expander 5 is equal to or lower than the first rotational speed is met. This is because the rotational speed of the pump 7 or the expander 5 is correlated with the electric power generated by the power generator 8 and is also correlated with the electric power discharged in the electric power absorber 25. Typically, the first rotational speed is a predetermined (unchanging) rotational speed. The first rotational speed is, for example, 5% to 30% of the rotational speed before a decrease in system voltage. Note, however, that the first rotational speed may be a rotational speed that changes in accordance with an operation state of the Rankine-cycle power-generating apparatus 100, and the like.

Details of Control Performed by Control Device

Figure 4:
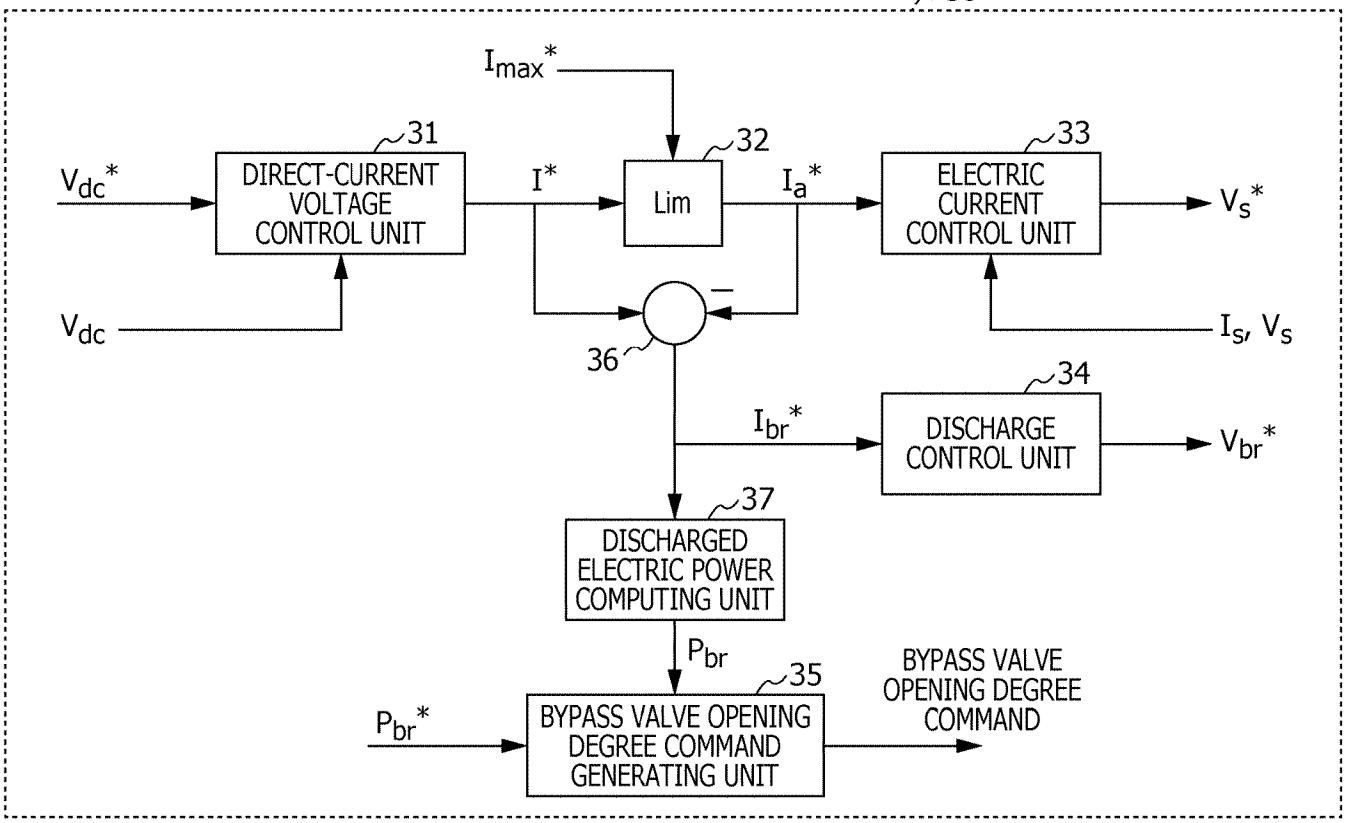
FIG. 4 is a block diagram of a control circuit.

As illustrated in FIG. 4, the control circuit 30 includes a direct-current voltage control unit 31, an electric current command limiting unit 32, an electric current control unit 33, a discharge control unit 34, a bypass valve opening degree command generating unit 35, a subtractor 36, and a discharged electric power computing unit 37.

The direct-current voltage control unit 31 calculates a first electric current command I* that allows a direct-current voltage $V_{dc}$ to match a direct-current voltage command $V_{dc}$*, for example, by PI control. The direct-current voltage $V_{dc}$ is detected by a sensor (not illustrated). The direct-current voltage command $V_{dc}$* corresponds to the target voltage.

The electric current command limiting unit 32 limits the first electric current command I* on the basis of a limit electric current $I_{max}$* and calculates a second electric current command $I_a$*. Specifically, in a case where the first electric current command I* is equal to or lower than the limit electric current $I_{max}$*, the electric current command limiting unit 32 outputs the first electric current command I* as the second electric current command $I_a$*. Meanwhile, in a case where the first electric current command I* is higher than the limit electric current $I_{max}$*, the electric current command limiting unit 32 outputs the limit electric current $I_{max}$* as the second electric current command $I_a$*. Typically, an upper limit value of an electric current fed to the electric power system 3 is given as the limit electric current $I_{max}$*. When the Rankine-cycle device 1 is disengaged from the electric power system 3, the limit electric current $I_{max}$* becomes zero, and the second electric current command $I_a$* also becomes zero accordingly. The second electric current command $I_a$* is a target value of the amplitude of an effective component of an electric current (effective electric current) supplied from the electric power converter for system interconnection 22 to the electric power system 3. In this example, a target value of an ineffective component of an electric current (ineffective electric current) supplied from the electric power converter for system interconnection 22 to the electric power system 3 is zero.

The electric current control unit 33 calculates a voltage command $V_s$* on the basis of the second electric current command $I_a$*, a phase electric current $I_s$, and a system voltage $V_s$. Specifically, the electric current control unit 33 calculates the voltage command $V_s$* that allows an effective component of the phase electric current $I_s$ to match the second electric current command $I_a$* and allows an ineffective component of the phase electric current $I_s$ to become zero, for example, by PI control. As for a more specific operation of the electric current control unit 33, see Patent Literature 2. For example, the technique concerning estimation of a phase of a system voltage described in Patent Literature 2 is also suitably applicable in the present embodiment. The phase electric current $I_s$ is detected by a sensor (not illustrated). The system voltage $V_s$ is detected by a sensor (not illustrated). The calculated voltage command $V_s$* is used by the electric power converter for system interconnection 22. Specifically, the electric power converter for system interconnection 22 outputs a voltage that matches the voltage command $V_s$*. For convenience of description, a case where a single-phase electric power system is used is described herein. However, the electric current control unit 33 can also be realized even in a case where a three-phase electric power system is used.

The subtractor 36 calculates a discharged electric current command $I_{br}$* by subtracting the second electric current command $I_a$* from the first electric current command I*. The discharged electric current command $I_{br}$* is a target value of a direct-current electric current (to be more accurate, a target value of an average of direct-current electric currents) that flows into the electric power absorber 25. As is clear from the above description, the first electric current command I* is a target value that allows the direct-current voltage $V_{dc}$ to match the direct-current voltage command $V_{dc}$*, and as electric current adjustment for obtaining the first electric current command I*, only the second electric current command $I_a$* (=I*) is adjusted in a case where the first electric current command I* is equal to or lower than the limit electric current $I_{max}$*, whereas the second electric current command $I_a$* and the discharged electric current command $I_{br}$* are adjusted in a case where the first electric current command I* is larger than the limit electric current $I_{max}$*.

The discharge control unit 34 calculates a discharged voltage command $V_{br}$* on the basis of the discharged electric current command $I_{br}$* and a resistance value of the discharging resistor of the electric power absorber 25. The electric power absorber 25 controls the switching element of FIG. 2 so that a voltage applied to the discharging resistor becomes the discharged voltage command $V_{br}$* on average. That is, the discharged voltage command $V_{br}$* is a target value of a voltage (to be more accurate, a target value of an average of voltages) applied to the discharging resistor. Although it is also possible to detect an electric current (discharged electric current) flowing through the electric power absorber 25 by using a sensor and calculate the discharged voltage command $V_{br}$* that allows a detection value thus obtained to match the discharged electric current command $I_{br}$*, for example, by a PI control, no sensor for detecting the discharged electric current is needed according to the control illustrated in FIG. 4.

The discharged electric power computing unit 37 computes discharged electric power $P_{br}$ on the basis of the discharged electric current command $I_{br}$* and the resistance value of the discharging resistor of the electric power absorber 25. Note that although the discharged electric power $P_{br}$ is computed on the basis of the discharged electric current command $I_{br}$* and the resistance value of the discharging resistor in the present embodiment, the discharged electric power $P_{br}$ may be computed on the basis of the discharged electric current command $I_{br}$* and the discharged voltage command $V_{br}$*.

The bypass valve opening degree command generating unit 35 calculates a bypass valve opening degree command so that a desired discharged electric power command $P_{br}$* matches the discharged electric power $P_{br}$, for example, by using a PI control. A bypass valve driving circuit (not illustrated) controls the degree of opening of the bypass valve 9 on the basis of the bypass valve opening degree command. The discharged electric power command $P_{br}$* corresponds to the first electric power P1.

As described above, during the period A1 in FIG. 3, the whole surplus electric power is fed to the electric power system 3. An example of an operation of the control circuit 30 during the period A1 is described below. In a case where the direct-current voltage $V_{dc}$ is larger than the direct-current voltage command $V_{dc}$* (target voltage), the first electric current command I* increases. The second electric current command $I_a$* that is equal to the first electric current command I* is generated. This is because the first electric current command I* is equal to or lower than the limit electric current value $I_{max}$* in the normal operation (operation during the period A1) in the example illustrated in FIG. 3. The voltage command $V_s$* calculated on the basis of the second electric current command $I_a$*, the phase electric current $I_s$, and the system voltage $V_s$ increases. As a result, the electric current and surplus electric power fed to the electric power system 3 increase. Since the first electric current command I* and the second electric current command $I_a$* are equal to each other, the discharged electric current command $I_{br}$*, which corresponds to a difference I*−$I_a$* between the first electric current command I* and the second electric current command $I_a$*, becomes zero. The discharged voltage command $V_{br}$* also becomes zero. As a result, a duty ratio (a ratio of an ON period to the sum of the ON period and an OFF period) of the switching element of the electric power absorber 25 becomes zero. The discharged voltage command $V_{br}$* and the bypass valve opening degree command are not generated. That is, the bypass valve opening degree command generating unit 35 and the discharged electric power computing unit 37 are not used.

As described above, during the period A2 in the example illustrated in FIG. 3, the electric current and electric power fed to the electric power system 3 are limited. An example of an operation of the control circuit 30 during the period A2 is described below. In a case where the direct-current voltage $V_{dc}$ is larger than the direct-current voltage command $V_{dc}$*, the first electric current command I* increases. The second electric current command $I_a$* that is equal to the limit electric current value $I_{max}$* is generated. This is because the first electric current command I* is larger than the limit electric current value $I_{max}$* in the operation during the period A2 in the example illustrated in FIG. 3. Since the second electric current command $I_a$* (=$I_{max}$*) does not change, the phase electric current $I_s$ does not change either. Since the first electric current command I* increases, the discharged electric current command $I_{br}$*, which corresponds to the difference I*−$I_a$* obtained by subtracting the second electric current command $I_a$* (=$I_{max}$*) from the first electric current command I*, also increases. The discharged voltage command $V_{br}$* also increases. As a result, the duty ratio of the switching element of the electric power absorber 25 increases. In the example of FIG. 3, the system voltage $V_s$ decreases and limitation of the second electric current command $I_a$* by the limit electric current value $I_{max}$* starts when transition from the period A1 to the period A2 occurs. Accordingly, the surplus electric power fed to the electric power system 3 decreases. The first electric current command I*, the discharged electric current command $I_{br}$*, and the discharged voltage command $V_{br}$* increase until a decreased amount of the surplus electric power fed to the electric power system 3 becomes equal to the discharged electric power in the electric power absorber 25.

The period A2 is a period in which part of the surplus electric power (the decreased amount of the surplus electric power fed to the electric power system 3) is consumed as discharged electric power. No bypass valve opening degree command is generated.

As described above, the period B1 is a period that starts at the same time as disengagement of the Rankine-cycle device 1 from the electric power system 3, is a period in which the specific operation is performed, and is a period in which the whole surplus electric power is discharged in the electric power absorber 25. An example of an operation of the control circuit 30 during the period B1 is described below. In a case where the direct-current voltage $V_{dc}$ is larger than the direct-current voltage command $V_{dc}$*, the first electric current command I* increases. Since the limit electric current value $I_{max}$* is zero, the second electric current command $I_a$* becomes zero. A voltage command $V_s$* that causes the electric current and surplus electric power fed to the electric power system 3 to be zero is calculated. Since the first electric current command I* increases, the discharged electric current command $I_{br}$*, which corresponds to a difference I*−$I_{max}$* (=I*) obtained by subtracting the limit electric current value $I_{max}$* (=0) from the first electric current command I*, also increases. The discharged voltage command $V_{br}$* also increases. As a result, the duty ratio of the switching element of the electric power absorber 25 increases. Since the discharged electric current command $I_{br}$* increases, the discharged electric power $P_{br}$ computed on the basis of the discharged electric current command $I_{br}$* and the resistance value of the discharging resistor of the electric power absorber 25 also increases. In a case where the discharged electric power $P_{br}$ is larger than the discharged electric power command $P_{br}$* (=the first electric power P1), a bypass valve opening degree command for increasing the degree of opening of the bypass valve 9 is generated. In a case where the discharged electric power $P_{br}$ is smaller than the discharged electric power command $P_{br}$*, a bypass valve opening degree command for lowering the degree of opening of the bypass valve 9 is generated.

Also during the periods B2 and B3, the control circuit 30 operates basically in a similar manner to the period B1. However, in a case where the duty ratio of the switching element is 100%, the duty ratio is not increased even in a case where the discharged voltage command $V_{br}$* increases. Furthermore, in a case where the bypass valve 9 is fully opened, the degree of opening of the bypass valve 9 is not increased even in a case where the discharged electric power $P_{br}$ is larger than the discharged electric power command $P_{br}$* (=the first electric power P1).

As is clear from the above description, the control circuit 30 controls the electric power converter for system interconnection 22, the electric power absorber 25, and the bypass valve (opening/closing device) 9. The electric power converter for system interconnection 22 is controlled by the voltage command $V_s$*. The electric power absorber 25 is controlled by the discharged voltage command $V_{br}$*. The bypass valve 9 is controlled by the bypass valve opening degree command. In the present embodiment, the control circuit 30 computes, in the specific operation, an electric current command (discharged electric current command $I_{br}$*) that is an electric current that should flow into the electric power absorber 25. Then, the control circuit 30 adjusts the degree of opening of the bypass valve (opening/closing device) 9 so that the direct-current electric power absorbed by the electric power absorber 25 approaches the first electric power P1 by using the electric current command. This makes a sensor for specifying the discharged electric power (discharged electric current) in the electric power absorber 25 unnecessary. Note that the expression "using the electric current command" means "using the electric current command or a value calculated from the electric current command" and also encompasses a case where discharged electric power $P_{br}$ calculated from the electric current command is used. Furthermore, in adjustment of the bypass valve 9, it is also possible to measure a discharged electric current in the electric power absorber 25 by using a sensor or the like and adjust the degree of opening of the bypass valve 9 so that discharged electric power calculated from a measurement value thus obtained becomes the first electric power P1.

The control circuit 30 of the present embodiment also controls the converter 20. Specifically, the control circuit 30 gives the converter 20 a voltage command $V_{uvw}$*. The converter 20 controls the power generator 8 so that a voltage applied to the power generator 8 matches the voltage command $V_{uvw}$*. As for details of control of the converter 20 and the power generator 8 based on the control circuit 30, see Patent Literature 3 for example.

Modification 1

In Embodiment 1, the bypass valve 9 is adjusted so that the discharged electric power in the electric power absorber 25 becomes the first electric power P1. However, it is also possible to adjust the degree of opening of the bypass valve 9 to a predetermined degree of opening by feedforward so that the discharged electric power falls within a predetermined range. Specifically, in Modification 1, in the specific operation, the degree of opening of the bypass valve (opening/closing device) 9 is increased to a predetermined intermediate degree of opening (a degree of opening between the fully-opened state and the fully-closed state) so that the direct-current electric power absorbed by the electric power absorber 25 falls within a predetermined (unchanging) range. Furthermore, in the specific operation, when the electric power consumption in the Rankine-cycle device 1 increases, the direct-current electric power absorbed by the electric power absorber 25 decreases and the electric power fed from the control device 2 to the Rankine-cycle device 1 increases. The predetermined range of the direct-current electric power is, for example, a range of not less than 1% and not more than 30% of the rated electric power of the power-generating apparatus 100. The predetermined intermediate degree of opening of the bypass valve 9 is, for example, a degree of opening in a range from 20% to 80%.

In Modification 1, the degree of opening of the bypass valve 9 is increased as described above after detection of the isolated operation state. Specifically, the degree of opening of the bypass valve 9 is increased as described above at the start of the specific operation (when the Rankine-cycle device 1 is disengaged from the electric power system 3). This lowers the electric power generated by the power generator 8, thereby reducing the discharged electric power in the electric power absorber 25. This arrangement is suitable for a reduction in size of the electric power absorber 25. Thereafter, the degree of opening of the bypass valve 9 is reduced upon detection of stoppage of heating of the evaporator 4 by a heat source.

Modification 2

Figure 5:
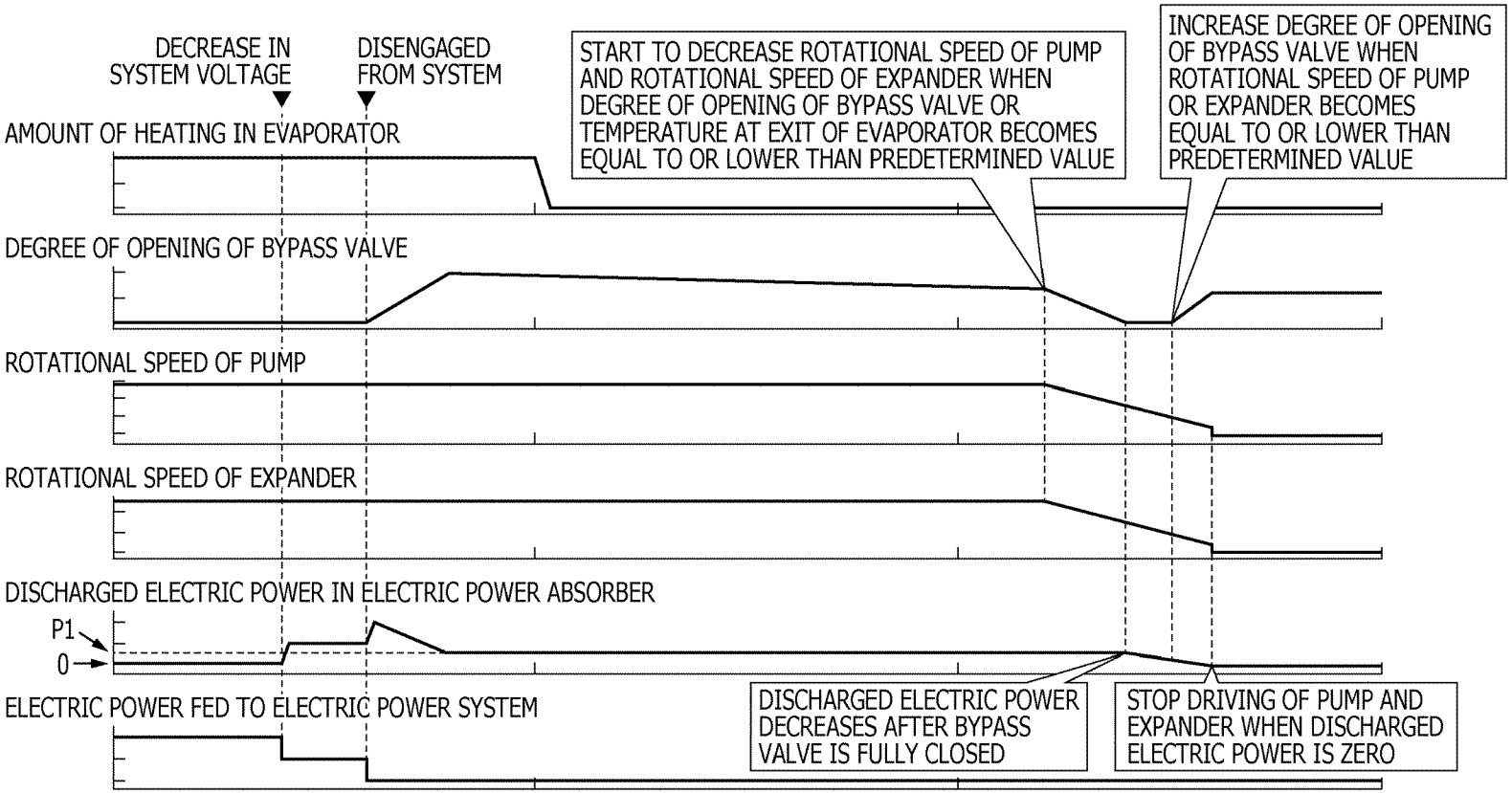
FIG. 5 is a timing chart for explaining operation of a Rankine-cycle power-generating apparatus according to Modification 2.

In Embodiment 1, the pump 7 and the expander 5 are stopped in a state where the degree of opening of the bypass valve 9 is small (more specifically, in a state where the bypass valve 9 is fully closed). However, it is also possible to increase the degree of opening of the bypass valve 9 before the pump 7 and the expander 5 are stopped. Specifically, in Modification 2, the degree of opening of the bypass valve (opening/closing device) 9 is increased when a condition that the direct-current electric power absorbed by the electric power absorber 25 is equal to or lower than a third electric power is met, as illustrated in FIG. 5. More specifically, the degree of opening of the bypass valve 9 is increased to 20% to 80% when the aforementioned condition is met. The third electric power is electric power that is smaller than the first electric power P1 and is larger than the second electric power. Typically, the third electric power is predetermined (unchanging) electric power. The third electric power is, for example, 10% to 90% of the first electric power. Note, however, that the third electric power may be electric power that changes in accordance with an operation state of the Rankine-cycle power-generating apparatus 100, and the like.

In a case where the operation condition of Embodiment 1 is employed, there are cases where the temperature of the working fluid is low and the working fluid contains liquid when the pump 7 and the expander 5 are stopped. In a case where the expander 5 sucks in the liquid working fluid, the liquid working fluid sometimes causes the expander 5 to eject lubricating oil, thereby causing shortage of the lubricating oil in the expander 5. The shortage of the lubricating oil causes the expander 5 to become worn earlier and increases loss in the expander 5. Furthermore, in a case where an expander using no lubricating oil (e.g., rotodynamic expander) is used in the Rankine-cycle device 1, the expander 5 that sucks in the liquid working fluid is corroded (physically corroded). However, according to Modification 2, it is less likely that the expander 5 sucks in the working fluid containing liquid after the pump 7 and the expander 5 are stopped.

It is also possible to increase the degree of opening of the bypass valve (opening/closing device) 9 when a condition that the rotational speed of the pump 7 or the expander 5 is equal to or lower than a second rotational speed is met. The second rotational speed is larger than the first rotational speed. Typically, the second rotational speed is a predetermined (unchanging) rotational speed. The second rotational speed is, for example, 5% to 40% of the rotational speed before a decrease of the system voltage. Note, however, that the second rotational speed may be a rotational speed that changes in accordance with an operation state of the Rankine-cycle power-generating apparatus 100, and the like. In this case, similar effects to those in Modification 2 can also be obtained.

Embodiment 2

Figure 6:
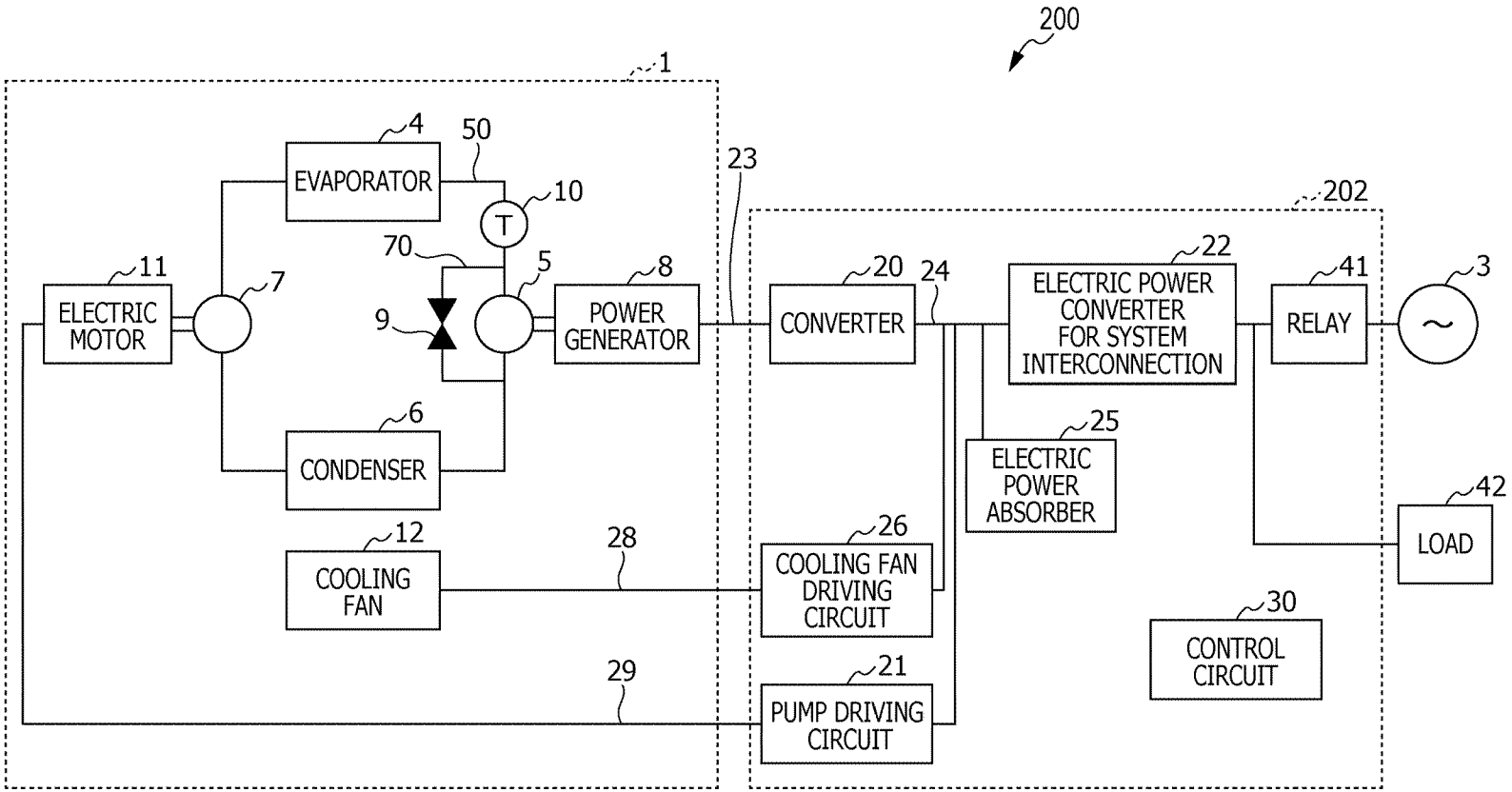
FIG. 6 is a block diagram of a Rankine-cycle power-generating apparatus according to Embodiment 2.

FIG. 6 is a block diagram of a power-generating apparatus (Rankine-cycle power-generating apparatus) 200 according to Embodiment 2 of the present disclosure. In FIG. 6, constituent elements that are identical to those in FIG. 1 are given identical reference signs, and description thereof is sometimes omitted.

As illustrated in FIG. 6, the power-generating apparatus 200 includes a control device 202 instead of the control device 2 of Embodiment 1. The control device 202 is connectable to a load 42.

The load 42 is connectable to an alternating-current wire that connects an electric power converter for system interconnection 22 and a relay 41 in the control device 202. The load 42 is, for example, an electric appliance.

To the electric power converter for system interconnection 22 and the load 42, alternating-current electric power is fed from an electric power system 3 via the relay 41. The electric power converter for system interconnection 22 converts the alternating-current electric power fed from the electric power system 3 into direct-current electric power. The obtained direct-current electric power is fed to a pump driving circuit 21 and a cooling fan driving circuit 26. The obtained direct-current electric power is also fed to a converter 20. The converter 20 converts alternating-current electric power generated by a power generator 8 into direct-current electric power while the power generator 8 is generating electric power. The obtained direct-current electric power is fed to the pump driving circuit 21 and the cooling fan driving circuit 26. In a case where the obtained direct-current electric power is larger than direct-current electric power that should be fed to the pump driving circuit 21 and the cooling fan driving circuit 26, part (surplus electric power) of the obtained direct-current electric power is converted into alternating-current electric power by the electric power converter for system interconnection 22. This alternating-current electric power is fed to the load 42. In a case where this alternating-current electric power is larger than electric power consumed by the load 42, part of the alternating-current electric power is fed (in a reverse power flow) to the electric power system 3 via the relay 41.

Control Sequence

A control sequence of the Rankine-cycle power-generating apparatus 200 is described below with reference to FIG. 7.

A period A1 is a period in which the electric power system 3 is normal and the power-generating apparatus 200 is in a normal operation state. During the period A1, electric power (surplus electric power) obtained by subtracting electric power used in the Rankine-cycle device 1 from electric power generated by the power generator 8 is entirely fed to the electric power system 3 and the load 42.

A period A2 is a period in which the voltage (system voltage) of the electric power system 3 falls and electric power fed to the electric power system 3 is limited due to an electric current limitation set by the electric power converter for system interconnection 22. During the A2 period, part of the surplus electric power is fed to the electric power system 3 and the load 42, and remaining surplus electric power is absorbed (discharged) by the electric power absorber 25. Although it may seem that the voltage (direct-current voltage) of the direct-current electric power line 24 rises when the electric power fed to the electric power system 3 and the load 42 is limited, the electric power discharged by the electric power absorber 25 is controlled so that the direct-current voltage becomes a target voltage in the present embodiment.

In a case where the system voltage does not recover within a predetermined limited period after detection of a decrease of the system voltage, the relay 41 disconnects (disengages) the Rankine-cycle device 1 from the electric power system 3. This forcibly eliminates the isolated operation state. A period B (periods B1*a*, B1*b*, B2, and B3) is a period in which the Rankine-cycle device 1 is disengaged from the electric power system 3. Also in the present embodiment, specific operation similar to that in Embodiment 1 is performed.

Figure 7:
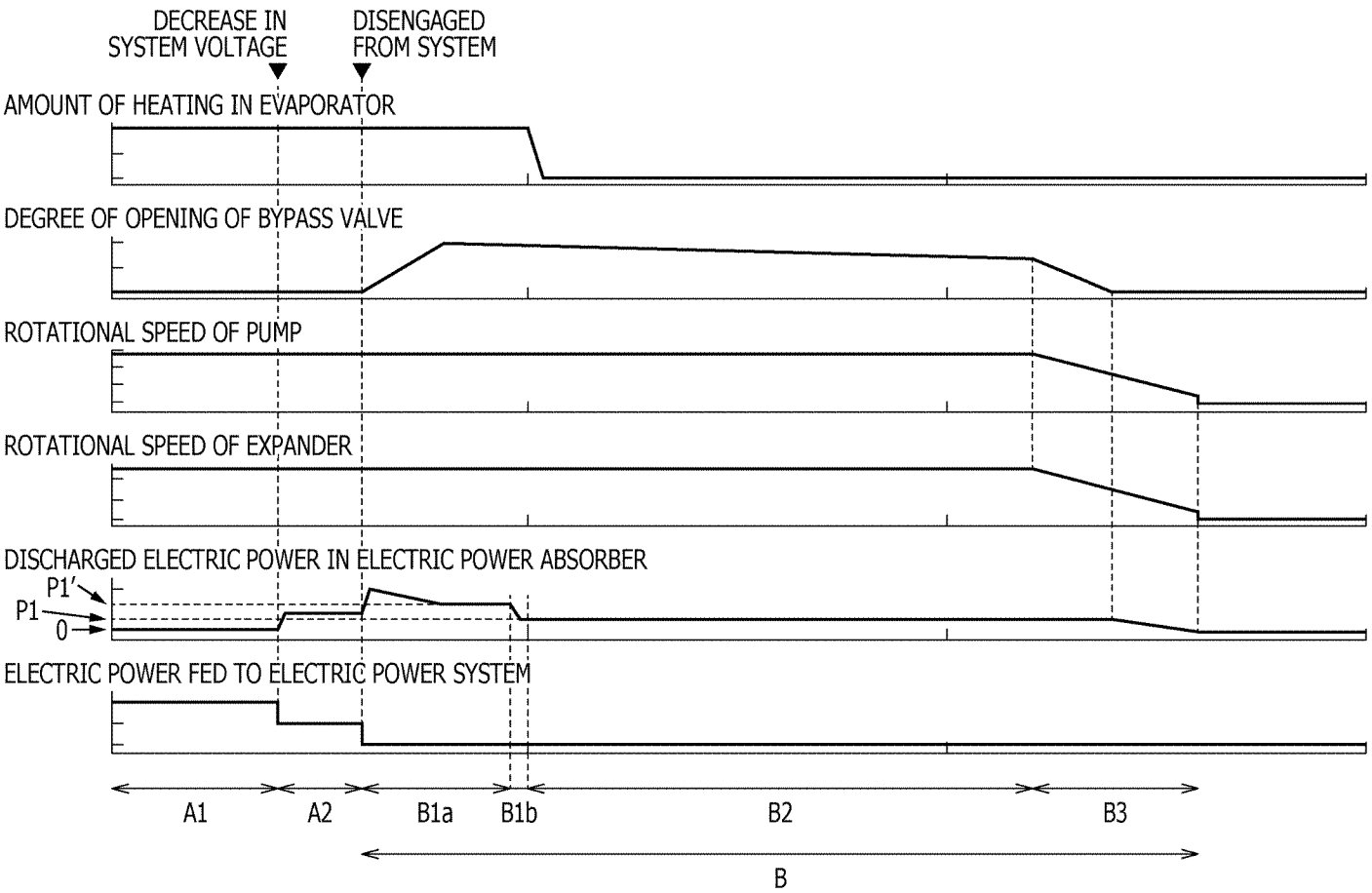
FIG. 7 is a timing chart for explaining operation of a Rankine-cycle power-generating apparatus according to Embodiment 2.

In the example illustrated in FIG. 7, during the period B1*a*, the degree of opening of a bypass valve 9 is adjusted by the control device 202 so that electric power absorbed by the electric power absorber 25 becomes first electric power P1'. In a case where the electric power absorbed by the electric power absorber 25 is larger than the first electric power P1', the degree of opening of the bypass valve 9 increases, and the electric power generated by the power generator 8 decreases. As a result, the electric power absorbed by the electric power absorber 25 decreases and approaches the first electric power P1'. According to such adjustment of the degree of opening of the bypass valve 9, a situation where the electric power absorbed by the electric power absorber 25 becomes far larger than the first electric power P1' does not occur. It is therefore possible to reduce the size of the electric power absorber 25.

The period B1*a* starts at the same time as disengagement of the Rankine-cycle device 1 from the electric power system 3. During the period B1*a*, electric power obtained by subtracting the electric power consumed by the load 42 from the surplus electric power is discharged in the electric power absorber 25. In an initial stage of the period B1*a*, the control device 202 increases the degree of opening of the bypass valve 9 so that the discharged electric power decreases and approaches the first electric power P1'. After the discharged electric power reaches the first electric power P1', the control device 202 adjusts the degree of opening of the bypass valve 9 so that the discharged electric power is kept at the first electric power P1'.

In a case where the electric power consumed by the load 42 is small, the first electric power P1' is, for example, 10% to 60% of the rated electric power of the power-generating apparatus 200. In the present embodiment, the first electric power P1' is 60% of the rated electric power. According to the present embodiment, even in a case where the electric power consumed by the load 42 fluctuates, the fluctuation can be smoothly compensated as long as the amount of fluctuation is equal to or lower than 60% of the rated electric power. it is also possible to employ an arrangement in which the first electric power P1' is changed so that the sum of the electric power consumed by the load 42 and the first electric power P1' is equal to or lower than the rated electric power in a case where the electric power consumed by the load 42 is variable.

During the period B1*a*, the Rankine-cycle power-generating apparatus 200 autonomously operates. The autonomous operation refers to a state where the Rankine-cycle device 1 operates the load 42 while being disengaged from the electric power system 3. As for autonomous operation, see Japanese Industrial Standards JIS C8960 (2012) for example. According to the present embodiment, electric power can be fed to the load 42 even in a case of power failure of the electric power system 3. Although the period B1*a* is short in FIG. 7, the period B1*a* may be long.

The period B1*a* is a period in which the electric power consumed by the load 42 is decreased (in the present embodiment, the electric power consumed by the load is set to zero by stopping a device that is the load) in order to stop operation of the Rankine-cycle power-generating apparatus 200. Note that, during the period B1*a* in the present embodiment, the first electric power is decreased from P1' to P1 since it is unnecessary for the electric power absorber 25 to continue absorption of electric power that compensate the fluctuation of the electric power consumed by the load 42 after the electric power consumed by the load 42 becomes zero. An example of a range of P1 is the same as that in Embodiment 1. Note, however, that the first electric power may be kept at P1'.

As for control during periods B2 and B3, see the description in Embodiment 1.

In Embodiment 2, electric power continues to be fed to the load 42 during the periods A1 to B1*a*. However, it is also possible to stop feeding of electric power to the load 42 once and resume feeding of electric power to the load 42 after elapse of a period in which the whole surplus electric power is absorbed by the electric power absorber 25. Such a period is suitably a period that straddles the time when the Rankine-cycle device 1 is disengaged from the electric power system 3. This makes it possible to safely switch a control mode even in a case where the control mode of the electric power converter for system interconnection 22 is markedly different between a case where the Rankine-cycle device 1 is connected to the electric power system 3 and a case where the Rankine-cycle device 1 is disengaged from the electric power system 3.

What is claimed is:

1. A Rankine-cycle power-generating apparatus comprising:

a Rankine-cycle device including:

an expander that converts expansion energy of a working fluid into mechanical energy, a bypass flow channel that bypasses the expander, an opening/closing device that opens/closes the bypass flow channel and whose degree of opening is adjustable to any of a fully opened state, a fully closed state, and an intermediate degree of opening between the fully opened state and the fully closed state, and a power generator that is linked to the expander; and a control device including:

a converter that converts alternating-current electric power generated by the power generator into direct-current electric power, an inverter that is connected to the converter via a direct-current electric power line and is capable of converting the direct-current electric power into alternating-current electric power and feeding the alternating-current electric power to a commercial system, and an electric power absorber that absorbs part of or all of the direct-current electric power, a specific operation being executable in the Rankine-cycle power-generating apparatus, a) in the specific operation, the control device is configured to output a command signal to the opening/closing device for adjusting the degree of opening so that the direct-current electric power absorbed by the electric power absorber approaches a first electric power, or b) in the specific operation, the control device is configured to output a command signal to the opening/closing device for increasing the degree of opening to the intermediate degree of opening so that the direct-current electric power absorbed by the electric power absorber falls within a predetermined range.

2. The Rankine-cycle power-generating apparatus according to claim 1, wherein A) in the specific operation, the control device is configured to output the command signal to the opening/closing device for adjusting the degree of opening by feedback control using the degree of opening of the opening/closing device as a manipulated variable so that the direct-current electric power absorbed by the electric power absorber approaches the first electric power; or b) in the specific operation, the control device is configured to output the command signal to the opening/closing device for increasing the degree of opening to the intermediate degree of opening so that the direct-current electric power absorbed by the electric power absorber falls within the predetermined range.

3. The Rankine-cycle power-generating apparatus according to claim 1, wherein the control device is configured to feed the direct-current electric power to the Rankine-cycle device, the Rankine-cycle device is configured to consume the direct-current electric power fed from the control device, α) in the specific operation, the control device is configured to output the command signal to the opening/closing device for adjusting the degree of opening so that the direct-current electric power absorbed by the electric power absorber approaches the first electric power, and in the specific operation, when electric power consumption in the Rankine-cycle device increases, the direct-current electric power absorbed by the electric power absorber temporarily decreases and electric power fed from the control device to the Rankine-cycle device increases, and then the direct-current electric power approaches the first electric power again; or β) in the specific operation, the control device is configured to output the command signal to the opening/closing device for increasing the degree of opening to the intermediate degree of opening so that the direct-current electric power absorbed by the electric power absorber falls within the predetermined range, and in the specific operation, when the electric power consumption in the Rankine-cycle device increases, the direct-current electric power absorbed by the electric power absorber decreases and electric power fed from the control device to the Rankine-cycle device increases.

4. The Rankine-cycle power-generating apparatus according to claim 1, wherein the Rankine-cycle device further includes a pump that delivers the working fluid by pressure;

the control device is configured to feed the direct-current electric power to the pump, and in the specific operation, part of the direct-current electric power fed from the control device is used as electric power for driving the pump.

5. The Rankine-cycle power-generating apparatus according to claim 1, wherein the control device is configured to feed the direct-current electric power to the Rankine-cycle device, the Rankine-cycle device is configured to consume the direct-current electric power fed from the control device, a) in the specific operation, the control device is configured to output the command signal to the opening/closing device for adjusting the degree of opening so that the direct-current electric power absorbed by the electric power absorber approaches the first electric power, and A) in the specific operation, the control device is configured to output the command signal to the opening/closing device for adjusting the degree of opening of the opening/closing device by feedback control using the degree of opening of the opening/closing device as a manipulated variable so that the direct-current electric power absorbed by the electric power absorber approaches the first electric power; or α) in the specific operation, the control device is configured to output the command signal to the opening/closing device for adjusting the degree of opening so that the direct-current electric power absorbed by the electric power absorber approaches the first electric power, and in the specific operation, when electric power consumption in the Rankine-cycle device increases, the direct-current electric power absorbed by the electric power absorber temporarily decreases and electric power fed from the control device to the Rankine-cycle device increases, and then the direct-current electric power approaches the first electric power again.

6. The Rankine-cycle power-generating apparatus according to claim 5, wherein the Rankine-cycle device further includes a pump that delivers the working fluid by pressure;

the control device is configured to feed the direct-current electric power to the pump, in the specific operation, part of the direct-current electric power fed from the control device is used as electric power for driving the pump; and in the specific operation, when the degree of opening of the opening/closing device decreases to a first degree of opening, the control device is configured to output a command signal to the pump for starting to decrease a rotational speed of the pump.

7. The Rankine-cycle power-generating apparatus according to claim 5, wherein the Rankine-cycle device further includes:

a pump that delivers the working fluid by pressure, an evaporator that heats the working fluid, and a sensor that is used to specify a temperature of the working fluid that is present in a flow passage starting from an exit of the evaporator and ending at an entry of the expander;

the control device is configured to feed the direct-current electric power to the pump, in the specific operation, part of the direct-current electric power fed from the control device is used as electric power for driving the pump; and in the specific operation, when the temperature specified by the sensor decreases to a first temperature, the control device is configured to output a command signal to the pump for starting to decrease a rotational speed of the pump.

8. The Rankine-cycle power-generating apparatus according to claim 6, wherein in the specific operation, when the rotational speed of the pump decreases, the control device is configured to output a command signal to the expander for decreasing a rotational speed of the expander.

9. The Rankine-cycle power-generating apparatus according to claim 6, wherein a rotational speed of the expander and the rotational speed of the pump are set to zero in a case where any of the following e) through g) is satisfied:

e) the direct-current electric power absorbed by the electric power absorber is equal to or smaller than a second electric power, the second electric power being smaller than the first electric power, f) a direct-current voltage of the direct-current electric power line is lower than a first voltage, and g) the rotational speed of the pump or the rotational speed of the expander is equal to or lower than a first rotational speed.

10. The Rankine-cycle power-generating apparatus according to claim 9, wherein the degree of opening of the opening/closing device is increased in a case where any of the following E) and G) is satisfied:

E) the direct-current electric power absorbed by the electric power absorber is equal to or smaller than a third electric power, the third electric power being smaller than the first electric power and larger than the second electric power, and G) the rotational speed of the pump or the rotational speed of the expander is equal to or smaller than a second rotational speed, the second rotational speed being larger than the first rotational speed.

11. The Rankine-cycle power-generating apparatus according to claim 5, wherein the control device further includes a control circuit that controls the inverter, the electric power absorber, and the opening/closing device; and in the specific operation, the control circuit computes an electric current command that is an electric current that should flow into the electric power absorber and adjusts the degree of opening of the opening/closing device so that the direct-current electric power absorbed by the electric power absorber approaches the first electric power by using the electric current command.

12. The Rankine-cycle power-generating apparatus according to claim 1, wherein the Rankine-cycle device further includes a condenser that cools the working fluid; and in the specific operation, the control device is configured to output a command signal to the opening/closing device for adjusting an amount of heat discharge of the condenser.

13. The Rankine-cycle power-generating apparatus according to claim 12, wherein the Rankine-cycle device further includes a cooling fan that cools the condenser; and in the specific operation, the control device is configured to output a command signal to the cooling fan for adjusting a rotational speed of the cooling fan to adjust the amount of heat discharge of the condenser.

14. The Rankine-cycle power-generating apparatus according to claim 13, wherein the control device is configured to feed the direct-current electric power to the cooling fan, and in the specific operation, the cooling fan is driven by using part of the direct-current electric power.

15. The Rankine-cycle power-generating apparatus according to claim 1, wherein the Rankine-cycle device is configured to disengage from the commercial system, and the specific operation is performed while the Rankine-cycle device is being disengaged from the commercial system.

* * * * *